US011118463B2

(12) United States Patent
Whitehurst et al.

(10) Patent No.: US 11,118,463 B2
(45) Date of Patent: Sep. 14, 2021

(54) ELECTRICALLY GROUNDING FAN PLATFORMS

(71) Applicant: UNITED TECHNOLOGIES CORPORATION, Farmington, CT (US)

(72) Inventors: Sean A. Whitehurst, South Windsor, CT (US); Patrick James McComb, Naugatuck, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 1121 days.

(21) Appl. No.: 14/597,902

(22) Filed: Jan. 15, 2015

(65) Prior Publication Data

US 2015/0292338 A1 Oct. 15, 2015

Related U.S. Application Data

(60) Provisional application No. 61/978,597, filed on Apr. 11, 2014.

(51) Int. Cl.

| | |
|---|---|
| ***F01D 5/28*** | (2006.01) |
| ***F01D 5/30*** | (2006.01) |
| ***F01D 11/00*** | (2006.01) |

(52) U.S. Cl.

CPC ..... *F01D 5/28* (2013.01); *F01D 5/3007* (2013.01); *F01D 11/008* (2013.01); *F05D 2220/32* (2013.01); *F05D 2220/36* (2013.01); *F05D 2230/90* (2013.01); *F05D 2240/80* (2013.01); *F05D 2300/50* (2013.01)

(58) Field of Classification Search

CPC . F01D 5/28; F01D 5/3007; F01D 5/30; F01D 11/008; F05D 2230/90; F05D 2220/32; F05D 2220/36; F05D 2240/80; F05D 2300/50

See application file for complete search history.

(56) References Cited

U.S. PATENT DOCUMENTS 3,694,104 A * 9/1972 Erwin ..... F01D 5/147 416/215
5,421,704 A * 6/1995 Carletti ..... F01D 11/008 416/193 A
5,466,125 A * 11/1995 Knott ..... F01D 5/3007 416/193 A (Continued)

FOREIGN PATENT DOCUMENTS

WO WO 2014/137448 A1 9/2014

OTHER PUBLICATIONS

European Search Report for Application No. 15163435.9 dated Aug. 13, 2015.

(Continued)

*Primary Examiner* — Richard A Edgar
(74) *Attorney, Agent, or Firm* — Cantor Colburn LLP

(57) ABSTRACT

A fan platform for electrically grounding an airfoil of a gas turbine engine includes a flow path surface extending between a first and second side. An inner surface radially opposing the flow path surface also extends between the first and second side, and includes a body portion extending radially inwardly therefrom. At least a first conductive path for grounding travels from the first side via the body portion.

18 Claims, 5 Drawing Sheets

(56) References Cited

U.S. PATENT DOCUMENTS

| | | | | |
|---|---|---|---|---|
| 6,447,250 | B1 * | 9/2002 | Corrigan | F01D 5/3007 416/193 A |
| 6,634,863 | B1 | 10/2003 | Forrester et al. | |
| 8,066,479 | B2 * | 11/2011 | El-Aini | F01D 11/008 416/1 |
| 8,827,651 | B2 * | 9/2014 | Bottome | F01D 11/008 416/193 R |
| 2005/0276691 | A1 | 12/2005 | Queriault et al. | |
| 2006/0137587 | A1 * | 6/2006 | Aisenbrey | B29C 70/18 114/65 R |
| 2010/0209251 | A1 | 8/2010 | Menheere et al. | |
| 2011/0243709 | A1 * | 10/2011 | El-Aini | F01D 11/008 415/1 |
| 2012/0167390 | A1 | 7/2012 | Rice | |
| 2013/0156588 | A1 * | 6/2013 | Murdock | F01D 5/147 416/220 R |

OTHER PUBLICATIONS

European Office Action for Application No. 15 163 435.9; dated: Jun. 27, 2018.

* cited by examiner

ELECTRICALLY GROUNDING FAN PLATFORMS

CROSS REFERENCE TO RELATED APPLICATION

This application claims priority under 35 USC § 119(e) to U.S. Provisional Patent Application Ser. No. 61/978,597 filed on Apr. 11, 2014.

TECHNICAL FIELD

The subject matter of the present disclosure relates generally to gas turbine engines and, more particularly, relates to fan platforms.

BACKGROUND

Gas turbine engines include a plurality of airfoils disposed circumferentially around the perimeter of a rotor disk. For optimum engine performance, it is ideal that the airfoils be light weight and stiff. As such, the material for airfoils has generally been changed from titanium to aluminum to reduce the weight of the airfoils. The aluminum airfoils do not share the same impact strength properties of titanium airfoils, however. In some instances, the aluminum airfoil is therefore covered with a polyurethane coating for protection. Additionally, the aluminum airfoil is also typically equipped with a protective sheath along the leading edge to improve impact strength and prevent airfoil damage from foreign object impact, such as impact with birds, hail or other debris. Often times the sheath is made from titanium or other high strength materials for protecting the airfoil from damage such as cracking, delamination, or deformation caused by impacting foreign objects.

During engine operation, these bi-metallic, multi-material airfoils create a static electric charge between the different materials, which may create a galvanic potential causing galvanic corrosion to occur between the different materials. Traditionally, the blade and the rotor disk were made of the same material or of materials that did not create a galvanic potential. With the implementation of the bi-metallic airfoils, which cannot be directly grounded to the rotor disk, other techniques for grounding the airfoil have needed to be utilized. For example, a spinner may include an electrically conductive aft edge, which facilitates in grounding the airfoil. As another example, a grounding tab may be adhesively connected to each airfoil so that the grounding tab directly engages a component that is in contact with the rotor disk or directly engages the rotor disk itself so that an electrical connection is formed to ground the airfoil to the rotor disk. The adhesive needs to have an insulating property so that the grounding tab does not create galvanic corrosion between the grounding tab and the main body portion of the airfoil to which it is attached. While effective, the grounding tabs are connected to the airfoils by an insulating adhesive, which, over time, may deteriorate and cause the grounding tab to become dislodged. The dislodged grounding tabs could create gaps between itself and the airfoil, thereby permitting moisture to penetrate therebetween and effecting the grounding connection. In addition, the use of grounding tabs adds additional components and manufacturing steps to the assembly process. Similarly, while effective, the spinner with an electrically conductive aft edge for grounding the airfoil also requires additional components to ensure that the aft edge is electrically isolated from the main body portion of the airfoil.

Accordingly, there is a need to provide a grounding path to prevent galvanic corrosion from occurring on bi-metallic airfoils that requires fewer components to thereby reduce assembly time and cost, while at the same time not increasing the overall weight of the engine.

SUMMARY

In accordance with an aspect of the disclosure, a fan platform for electrically grounding an airfoil of a gas turbine engine is provided. The fan platform may include a flow path surface extending between a first side and a second side. An inner surface may also extend between the first and second side so that the inner surface radially opposes the flow path surface. A body portion may extend radially inwardly from the inner surface. At least a first conductive path for grounding may travel along the first side via the body portion.

In accordance with another aspect of the disclosure, a first edge seal may be disposed on the first side so that the at least first conductive path includes traveling from the first side to the body portion via the first edge seal.

In accordance with yet another aspect of the disclosure, at least a second conductive path for grounding may travel via the second side via the body portion.

In accordance with still yet another aspect of the disclosure, a second edge seal may be disposed on the second side so that the at least second conductive path may travel from the second side to the body portion via the second edge seal.

In further accordance with another aspect of the disclosure, the body portion may include a plurality of devises.

In further accordance with yet another aspect of the disclosure, the body portion may include a plurality of hooks.

In further accordance with still yet another aspect of the disclosure, the at least first conductive path may be formed by coating the first edge seal, the first side, and the body portion in a conductive material. The at least second conductive path may be formed by coating the second edge seal, the second side, and the body portion in the conductive material.

In further accordance with an even further aspect of the disclosure, the at least first conductive path may be formed by integrally forming a first conductive material into each of the first edge seal, the first side, and the body portion. The at least second conductive path may be formed by integrally forming a second conductive material into each of the second edge seal, the second side, and the body portion.

In accordance with another aspect of the disclosure, a gas turbine engine is provided. The gas turbine may include a rotor disk with a plurality of airfoils extending radially outwardly therefrom so that each airfoil of the plurality of airfoils may be circumferentially spaced apart from one another. A sheath may cover a leading edge of each airfoil. A plurality of discrete fan platforms may be disposed between adjacent airfoils. Each discrete fan platform may include a flow path surface and an inner surface both extending between a first and second side so that the inner surface radially opposes the flow path surface. A body portion may extend radially inwardly from the inner surface and may be disposed on the rotor disk. At least a first conductive path for grounding the sheath may operatively travel from the sheath along the first side via the body portion to the rotor disk.

In accordance with still another aspect of the disclosure, a first edge seal may be disposed on the first side so that the at least first conductive path includes operatively traveling from the sheath to the first side via the first edge seal.

In accordance with still yet another aspect of the disclosure, at least a second conductive path for grounding a sheath of an adjacent airfoil may operatively travel from the sheath of the adjacent airfoil via the second side via the body portion to the rotor disk.

In accordance with an even further aspect of the disclosure, a second edge seal may be disposed on the second side so that the at least second conductive path for grounding the sheath of the adjacent airfoil may operatively travel from the sheath of the adjacent airfoil to the second side via the second edge seal.

In accordance with still an even further aspect of the disclosure, the body portion may include a plurality of devises attached to corresponding lugs disposed on the rotor disk.

In further accordance with yet another aspect of the disclosure, the body portion may include a plurality of platform hooks retained to corresponding retention hooks disposed on the rotor disk.

In accordance with another aspect of the disclosure, a method of electrically grounding an airfoil of a gas turbine engine is provided. The method entails providing a flow path surface and an inner surface both extending between a first side and a second side so that the inner surface radially opposes the flow path surface and a body portion extending radially inwardly from the inner surface. Another step may be forming at least a first conductive path for grounding that travels from the first side via the body portion. Yet another step may include grounding the airfoil through the at least first conductive path.

In accordance with yet another aspect of the disclosure, the method may include forming a first edge seal on the first side so that the at least first conductive path for grounding includes traveling from the first side to the body portion via the first edge seal and forming a second edge seal on the second side so that an least second conductive path for grounding includes traveling from the second side via the second edge seal via the body portion.

In accordance with still yet another aspect of the disclosure, the method may include forming the at least first conductive path for grounding by coating each of the first side, the first edge seal, and the body portion in a conductive material, and forming the at least second conductive path for grounding by coating each of the second side, the second edge seal, and the body portion in the conductive material.

In accordance with still an even further aspect of the disclosure, the method may include forming the at least first conductive path for grounding by integrally forming a conductive material into each of the first side, the first edge seal, and the body portion, and forming the at least second conductive path for grounding by integrally forming a second conductive material into each of the second side, the second edge seal, and the body portion.

Other aspects and features of the disclosed systems and methods will be appreciated from reading the attached detailed description in conjunction with the included drawing figures. Moreover, selected aspects and features of one example embodiment may be combined with various selected aspects and features of other example embodiments.

BRIEF DESCRIPTION OF THE DRAWINGS

For further understanding of the disclosed concepts and embodiments, reference may be made to the following detailed description, read in connection with the drawings, wherein like elements are numbered alike, and in which.

It is to be noted that the appended drawings illustrate only typical embodiments and are therefore not to be considered limiting with respect to the scope of the disclosure or claims. Rather, the concepts of the present disclosure may apply within other equally effective embodiments. Moreover, the drawings are not necessarily to scale, emphasis generally being placed upon illustrating the principles of certain embodiments.

DETAILED DESCRIPTION

Throughout this specification the terms "downstream" and "upstream" are used with reference to the general direction of gas flow through the engine and the terms "axial", "radial" and "circumferential" are generally used with respect to the longitudinal central engine axis.

Figure 1:
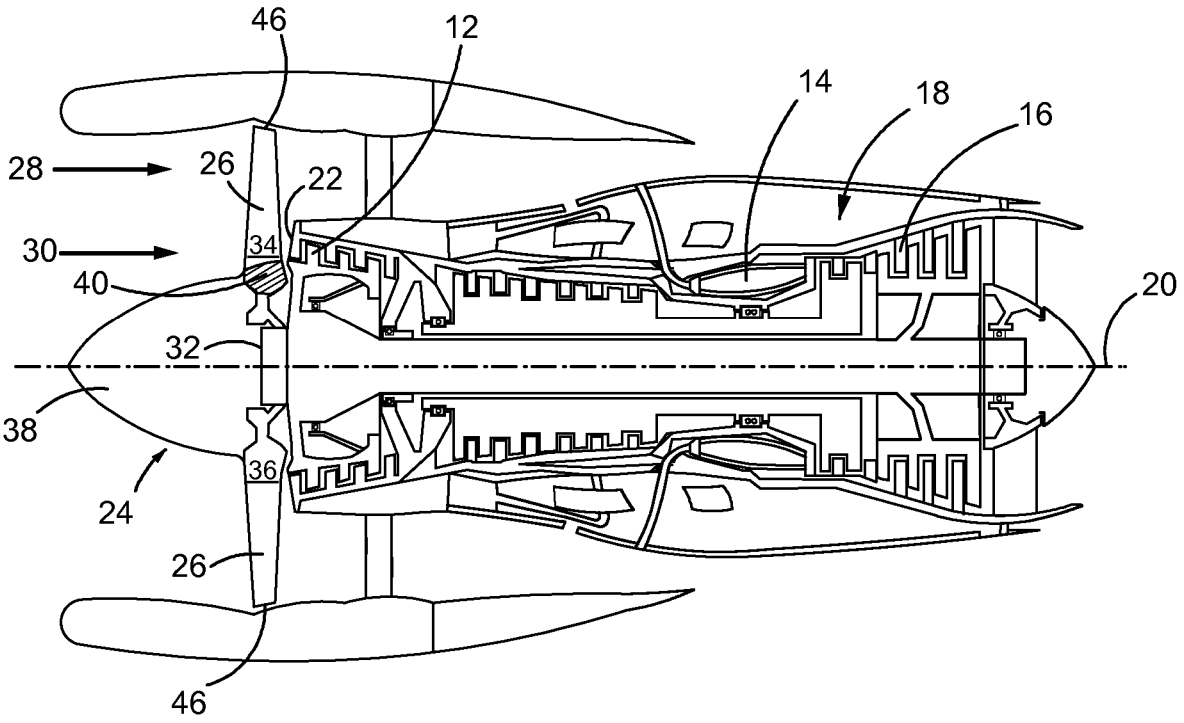
FIG. 1 is a side view of a gas turbine engine with portions sectioned and broken away to show details of the present disclosure.

Referring now to FIG. 1, a gas turbine engine constructed in accordance with the present disclosure is generally referred to by reference numeral 10. The gas turbine engine 10 includes a compressor section 12, a combustor 14 and a turbine section 16. The serial combination of the compressor section 12, the combustor 14 and the turbine section 16 is commonly referred to as a core engine 18. The engine 10 is circumscribed about a longitudinal central axis 20.

Air enters the compressor section 12 at the compressor inlet 22 and is pressurized. The pressurized air then enters the combustor 14. In the combustor 14, the air mixes with jet fuel and is burned, generating hot combustion gases that flow downstream to the turbine section 16. The turbine section 16 extracts energy from the hot combustion gases to drive the compressor section 12 and a fan 24, which includes a plurality of airfoils 26 (two airfoils shown in FIG. 1). As the turbine section 16 drives the fan 24, the airfoils 26 rotate so as to take in more ambient air. This process accelerates the ambient air 28 to provide the majority of the useful thrust produced by the engine 10. Generally, in some modern gas turbine engines, the fan 24 has a much greater diameter than the core engine 18. Because of this, the ambient air flow 28 through the fan 24 can be 5-10 times higher, or more, than the core air flow 30 through the core engine 18. The ratio of flow through the fan 24 relative to flow through the core engine 18 is known as the bypass ratio.

The fan 24 includes a rotor disk 32 from which the airfoils 26 extend radially outwardly. The airfoils 26 are circumferentially spaced apart from one another around the rotor disk 32. Each of the airfoils 26 includes a pressure surface side 34 and an opposite-facing suction surface side 36. A conical spinner 38 extends from the upstream side of the rotor disk 32 and defines an aerodynamic flow path. The fan 24 also includes a plurality of discrete fan platforms 40 (only one shown in FIG. 1). Each discrete fan platform of the plurality of discrete fan platforms 40 is disposed between adjacent airfoils 26.

A more detailed description of the airfoils 26 is discussed below with particular reference to FIGS. 2 and 3. The pressure surface side 34 and the suction surface side 36 of each airfoil 26 may extend in a chordwise direction between a leading edge 42 and a trailing edge 44 and may extend in a spanwise direction between a tip 46 and a transition portion 48. The transition portion 48 is integrally joined to a dovetail root 50, which may be insertably retained into a corresponding dovetail slot 52 disposed on the rotor disk 32.

A sheath 53 covers the leading edge 42 and may extend in a spanwise direction between the tip 46 and the transition portion 48. The sheath 53 includes a pressure side flange 54, which covers a minimum section of the pressure surface side 34. Similarly, the sheath 53 also includes a suction side flange 56, which covers a minimum section of the suction surface side 36. The flanges 54, 56 cover an appropriate minimum section of the respective surface sides 34, 36 to ensure adequate joining of the sheath 53 to the airfoil 26 without adding undue weight to the airfoil 26. Because the sheath 53 is formed of a stronger material than the airfoil 26, the sheath 53 protects the leading edge 42 from impact damage from foreign objects such as from bird strikes. As a non-limiting example, the airfoil 26 may be formed of aluminum or various aluminum alloys. In addition, the airfoil 26 may be coated with a protective coating, such as polyurethane or other protective coatings, which prevents erosion, but may have insulation qualities that inhibit grounding of the airfoil 26. The sheath 53, on the other hand, may be formed of a stronger, more conductive material than the airfoil 26 such as, but not limited to, titanium, titanium alloys, or other appropriate metals. Because the sheath 53 and airfoil 26 are formed of different materials, an electrical charge may build up in the sheath 53 creating a galvanic potential between the different materials during operation.

Figure 2:
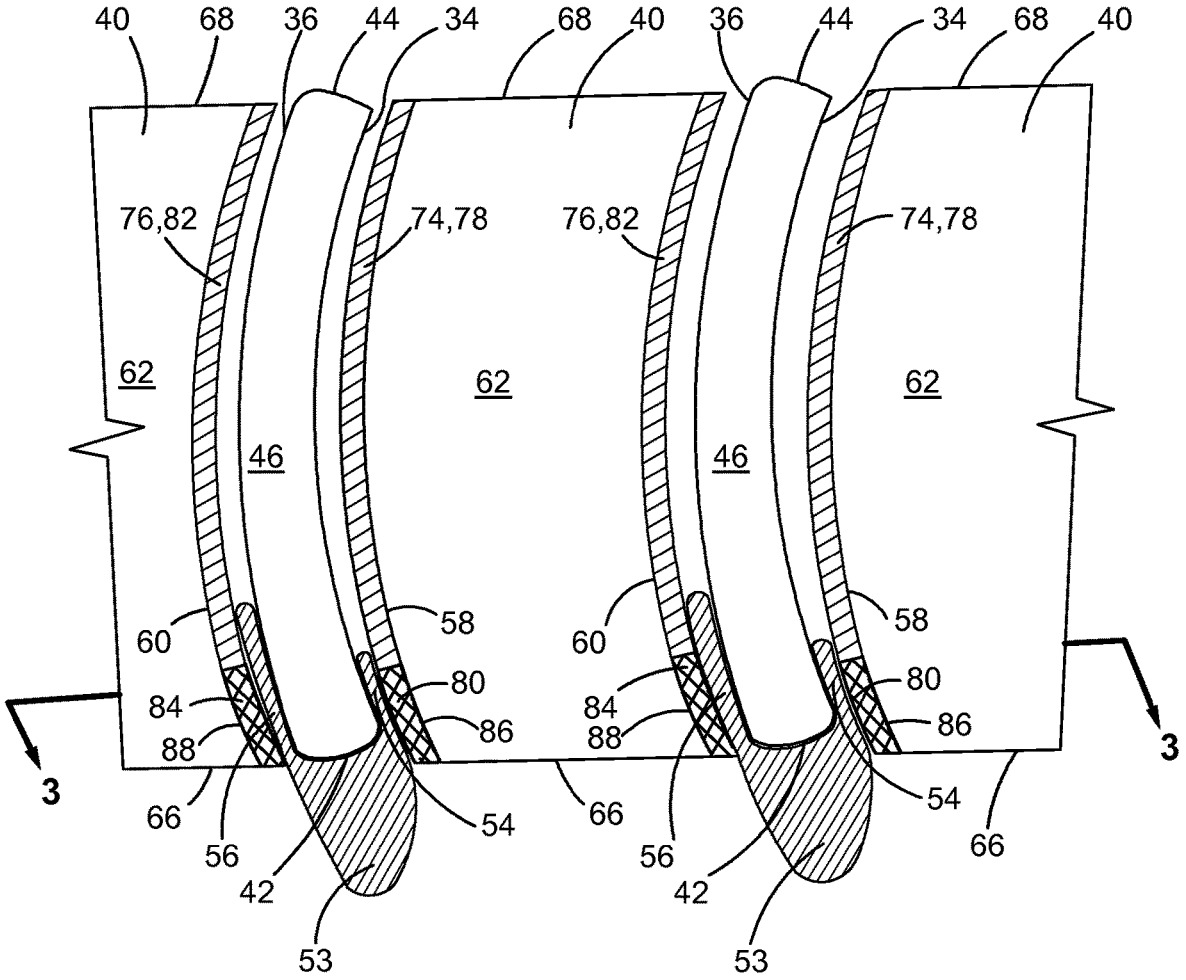
FIG. 2 is a perspective view looking radially inwardly to show details of the present disclosure.
Figure 3:
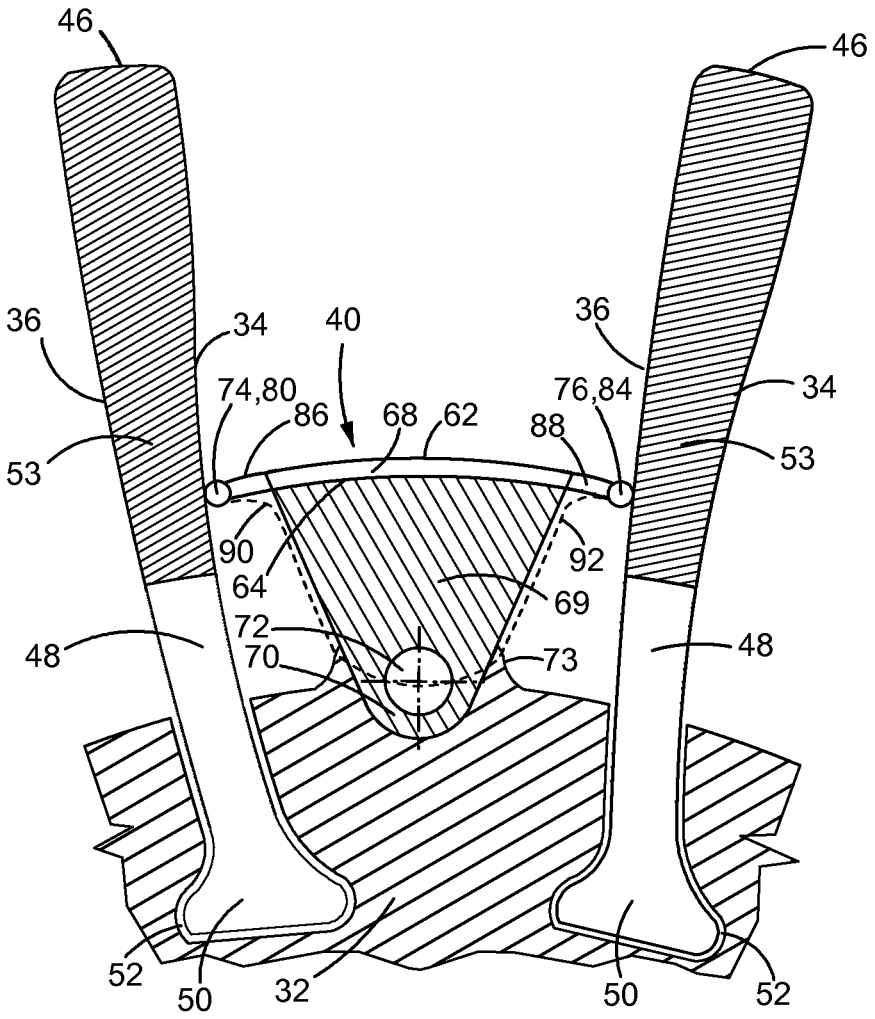
FIG. 3 is a front view taken along line 3-3 of FIG. 2 with portions sectioned and broken away to show details of the present disclosure.

As shown in FIGS. 2 and 3, each discrete fan platform 40 includes a first side 58, a second side 60, and an outer flow path surface 62 extending between the first and second sides 58, 60. The fan platform 40 also includes an inner surface 64 that extends between the first and second sides 58, 60 and oppositely faces the outer flow path surface 62. The outer flow path surface 62 and the inner surface 64 both extend axially between an upstream end 66 disposed adjacent to the spinner 38 and a downstream end 68 disposed adjacent to the compressor inlet 22. The outer flow path surface 62 of each discrete fan platform 40 is contoured so that, during engine 10 operation, it defines a continuous aerodynamic flow path with the spinner 38 allowing the air flow 30 to pass smoothly into the compressor inlet 22. The first side 58 may be contoured to complementarily match the contour of the pressure surface side 34 of its adjacent airfoil 26. Similarly, the second side 60 may be contoured to complementarily match the contour of the suction surface side 36 of its adjacent airfoil 26.

The fan platform 40 also includes a body portion 69 that extends radially inwardly from the inner surface 64. The body portion 69 may include a plurality of attachment members, such as, but not limited to, a plurality of clevises 70 (one clevis shown in FIG. 3) or a plurality of platform hooks 71 (one platform hook shown in FIG. 4), for attachment to the rotor disk 32. In particular, for a body portion 69 that includes a plurality of clevises 70, a pin 72 may be inserted through the plurality of devises 70 and a corresponding plurality of lugs 73 (one shown in FIG. 3) disposed on the rotor disk 32 to secure the fan platform 40 to the rotor disk 32. The pin 72 may be formed of any conductive material such as, but not limited to, titanium, titanium alloy, copper, steel, and nickel. The fan platform 40 may be formed of various materials, such as metal, composite, chopped and woven fiber, and non-coated plastic, to name a few non-limiting examples.

A first edge seal 74 may be disposed on the first side 58 and a second edge seal 76 may be disposed on the second side 60. The first edge seal 74 includes a pressure side contact region 78, which may engage the pressure surface side 34 of an adjacent airfoil 26, and a pressure side flange contact region 80, which may engage the pressure side flange 54 of the sheath 53 of the adjacent airfoil 26. In similar fashion, the second edge seal 76 includes a suction side contact region 82, which may engage the suction surface side 36 of an adjacent airfoil 26, and a suction side flange contact region 84, which may engage the suction side flange 56 of the adjacent sheath 53 of the adjacent airfoil 26. The pressure side flange contact region 80 also engages a first platform contact region 86, which is adjacent the upstream end 66. Similarly, the suction side flange contact region 84 engages a second platform contact region 88, which is also adjacent the upstream end 66. In addition to preventing air from flowing through gaps between the discrete fan platform 40 and adjacent airfoils 26, the edge seals 74, 76 also protect against wear damage by preventing direct contact of the fan platform 40 with the adjacent airfoils 26 during engine 10 operation. The first and second edge seals 74, 76 may be formed of, but not limited to, rubber or braided composite.

In an embodiment where the sheath 53 is formed of a material that is more conductive than the material of the airfoil 26, the static electric charge that may build up in the sheath 53, during engine 10 operation, needs to dissipate through a first conductive path 90 for grounding to prevent a galvanic potential from forming and causing galvanic corrosion between the different materials. During engine 10 operation, the first conductive path 90 for grounding may travel from the pressure side flange 54 of the sheath 53 via the pressure side flange contact region 80 of the first edge seal 74 via the first platform contact region 86 and then via the body portion 69 into the metallic rotor disk 32. The first conductive path 90 for grounding may be achieved by integrating a conductive material with the pressure side flange contact region 80, the first platform contact region 86, and the body portion 69. Each of the pressure side flange contact region 80, the first platform contact region 86, and the body portion 69 may be coated with the conductive material such that the conductive material on each component is in direct surface contact with the conductive material of the adjacent component so as to create the first conductive path 90 for grounding the sheath 53 to the rotor disk 32 during engine 10 operation. Instead of coating, a conductive material may be formed integrally with each of the pressure side flange contact region 80, the first platform contact region 86, and the body portion 69 so that the conductive materials of each component engage in direct surface contact with the conductive material of the adjacent component so as to complete the first conductive path 90 for grounding the sheath 53 to the rotor disk 32 during engine 10 operation. The conductive material may be any suitable conductive material such as, but not limited to, titanium, titanium alloy, copper, steel or nickel. The coating may be done in any conventional manner such as, but not limited to, plating.

In a similar fashion, a second conductive path 92 for grounding may travel from the suction side flange 56 of the sheath 53 via the suction side flange contact region 84 of the second edge seal 76 via the second platform contact region 88 and then via the body portion 69 into the metallic rotor disk 32. Similar to the first conductive path 90, the second conductive path 92 for grounding the sheath 53 to the metallic rotor disk 32, during engine 10 operation, may also be created by coating or forming integrally a conductive material with each of the suction side flange contact region 84, the second platform contact region 88, and the body portion 69 so that the conductive material of each component is in direct surface contact with the conductive material of the adjacent component.

Although the first and second conductive paths 90, 92 are described as being utilized in combination, it is also within the scope of the disclosure for either the first conductive path 90 or the second conductive path 92 to be utilized alone to dissipate the static electric charge built up in the sheath 53. Furthermore, in any combination of utilizing the first and second conductive paths 90, 92 in which the paths 90, 92 are partially formed integrally with the body portion 69 of the fan platform 40, the paths 90, 92 may include the conductive pin 72, which is in direct surface contact with the lug 73 of the rotor disk 32. It should also be noted that the body portion 69 of the fan platform 40 may be fabricated from a conductive material, in which case, the body portion 69 would not need to be coated with a conductive material.

Figure 4:
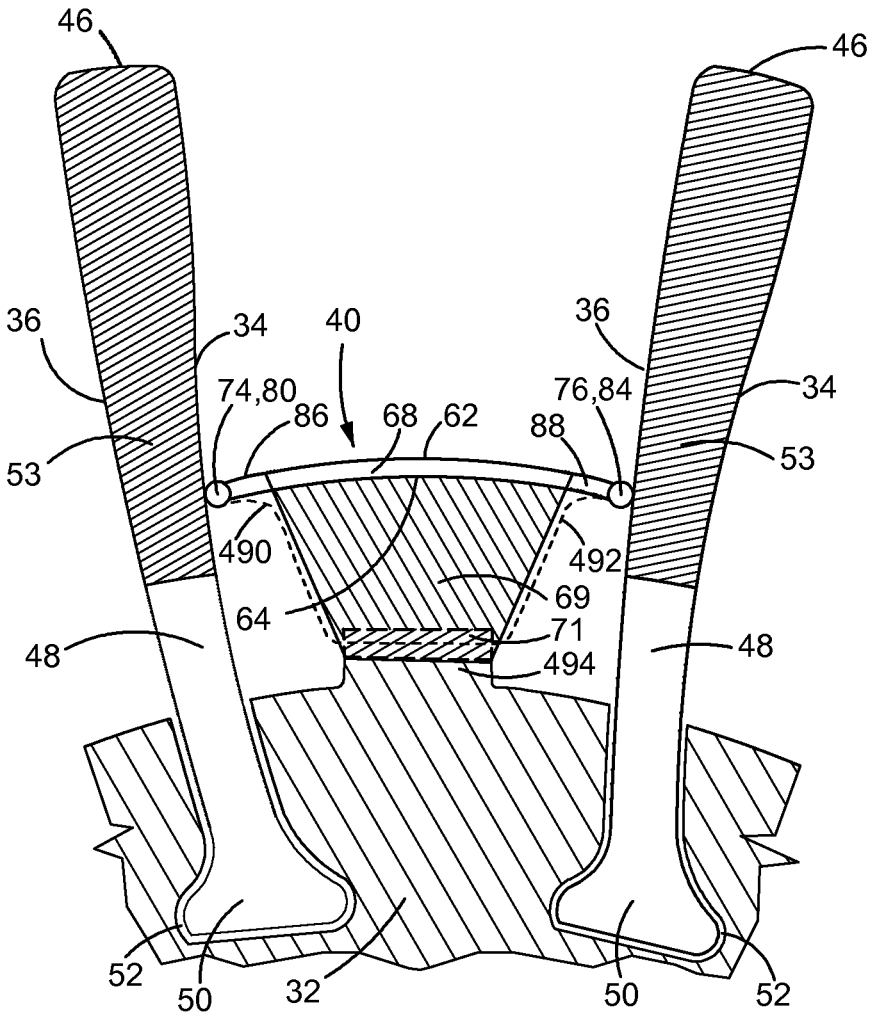
FIG. 4 is a front view similar to FIG. 3, but depicting an alternative embodiment constructed in accordance with the teachings of the present disclosure.

FIG. 4 illustrates an embodiment that utilizes a plurality of platform hooks 71 (one shown) instead of a plurality of clevises 70 (see FIG. 3) to attach the body portion 69 of the fan platform 40 to the rotor disk 32. The first and second conductive paths 490, 492 are the same as the first and second paths 90, 92 described above, as the only difference is that the body portion 69 of the fan platform 40 is attached via platform hooks 71 instead of clevises 60. In particular, the plurality of platform hooks 71 may be attached to corresponding retention hooks 494 (one shown) disposed on the rotor disk 32.

During engine 10 operation, the rotation of the fan 24 forces the sheath 53 of each airfoil 26 to engage with the first and second edge seals 74, 76 of each fan platform 40. In this operating configuration, the first and second conductive paths 90, 92 are formed and allow the static electric charge built up in the sheath 53 to dissipate through the paths 90, 92 to the metallic rotor disk 32. With the sheath 53 grounded, the risk of galvanic corrosion between the sheath 53 and airfoil 26 is eliminated.

Figure 5:
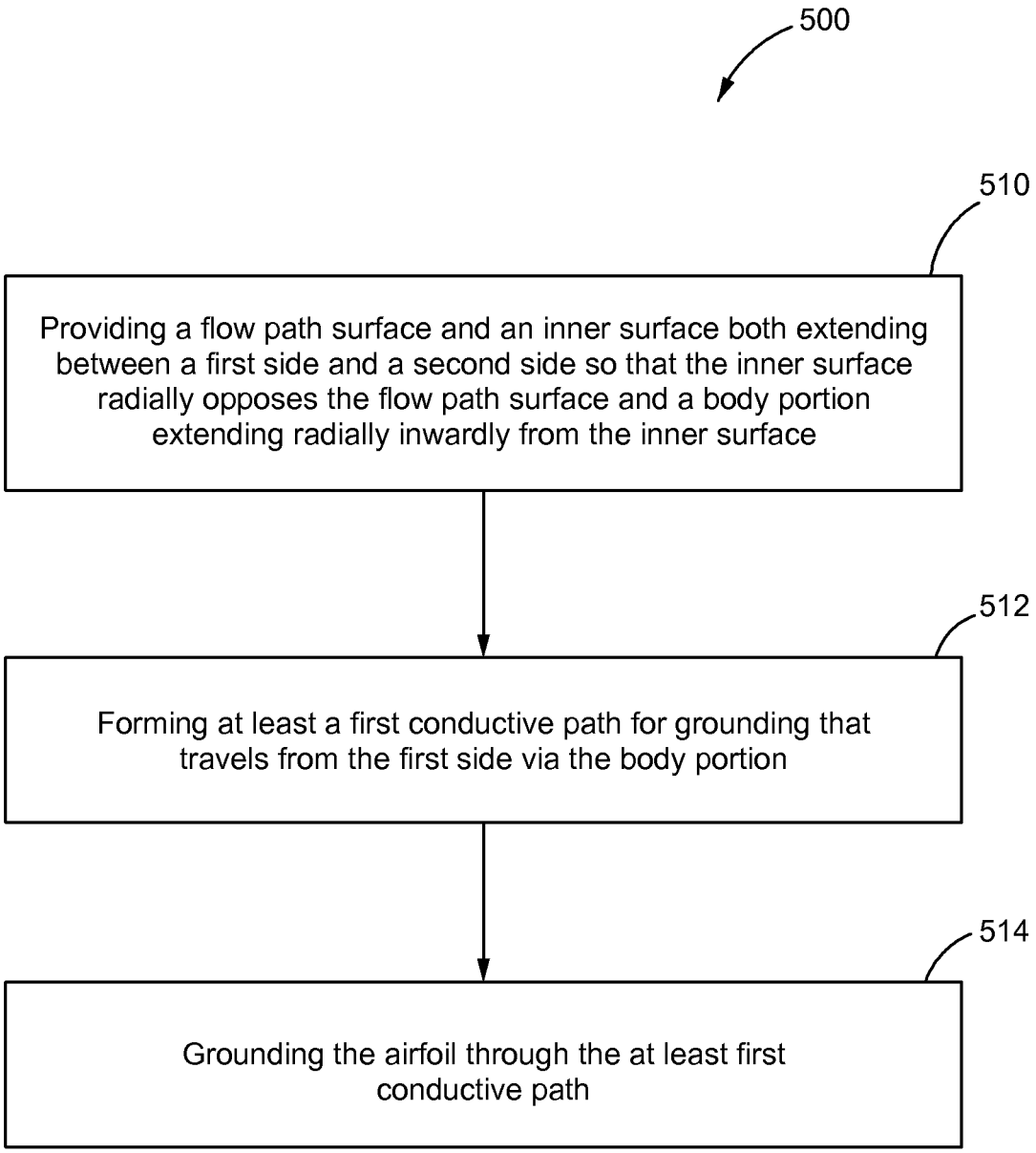
FIG. 5 is a flowchart illustrating a sample sequence of steps which may be practiced in accordance with the teachings of this disclosure.

FIG. 5 illustrates a flow chart 500 of a sample sequence of steps which may be performed for electrically grounding an airfoil of a gas turbine engine. Box 510 shows the step of providing a flow path surface and an inner surface both extending between a first side and a second side so that the inner surface radially opposes the flow path surface and a body portion extending radially inwardly from the inner surface. Another step, as illustrated in box 512, is forming at least a first conductive path for grounding that travels from the first side via the body portion. As shown in box 514, another step may be grounding the airfoil through the first conductive path. A first edge seal may be formed on the first side so that the at least first conductive path for grounding includes traveling from the first side to the body portion via the first edge seal. A second edge seal may be formed on the second side so that an at least second conductive path for grounding includes traveling from the second side via the second edge seal via the body portion. The at least first conductive path for grounding may be formed by coating each of the first side, the first edge seal, and the body portion in a conductive material. The at least second conductive path for grounding may be formed by coating each of the second side, the second edge seal, and the body portion in the conductive material. The at least first conductive path for grounding may also be formed by integrally forming a conductive material into each of the first side, the first edge seal, and the body portion. Similarly, the at least second conductive path for grounding may also be formed by integrally forming a second conductive material into each of the second side, the second edge seal, and the body portion.

While the present disclosure has shown and described details of exemplary embodiments, it will be understood by one skilled in the art that various changes in detail may be effected therein without departing from the spirit and scope of the disclosure as defined by claims supported by the written description and drawings. Further, where these exemplary embodiments (and other related derivations) are described with reference to a certain number of elements it will be understood that other exemplary embodiments may be practiced utilizing either less than or more than the certain number of elements.

INDUSTRIAL APPLICABILITY

Based on the foregoing, it can be seen that the present disclosure sets forth a discrete fan platform for electrically grounding an airfoil of a gas turbine engine. The teachings of this disclosure can be employed to reduce part number count and assembly time for grounding the sheath of an airfoil, while at the same time not increasing the overall weight of the engine. Moreover, through the novel teachings set forth above, the sheath of the airfoil may be grounded with less risk of disturbances to the grounding path over time and thus reducing maintenance costs. Furthermore, the present disclosure ensures that galvanic corrosion will not occur on bi-metallic or multi-material airfoils.

What is claimed is:

1. A rotor disk for use in a gas turbine engine, the rotor disk comprising:

a plurality of airfoils formed from aluminum or an aluminum alloy extending radially outwardly from the rotor disk, each airfoil of the plurality of airfoils being circumferentially spaced apart from one another;

a sheath covering a leading edge of each airfoil, wherein the sheath is formed from a different material than the airfoil;

a plurality of discrete fan platforms located between adjacent airfoils and configured to ground the sheath of one of the adjacent airfoils to the rotor disk without using the airfoil as a conductor;

wherein each fan platform has a flow path surface extending between a first side and a second side;

an inner surface extending between the first side and the second sides, the inner surface radially opposing the flow path surface; and a body portion extending radially inwardly from the inner surface, the body portion being secured to the rotor disk.

2. The rotor disk of claim 1, further including a first edge seal disposed on the first side, wherein the first edge seal provides a conductive path between the body portion and the sheath.

3. The rotor disk of claim 2, further including a second edge seal disposed on the second side, wherein the second edge seal provides a conductive path between the body portion and the sheath.

4. The rotor disk of claim 3, wherein the first edge seal, the second edge seal, the first side, the second side, and the body portion are coated with a conductive material.

5. The rotor disk of claim 3, wherein a first conductive material is integrally formed into each of the first edge seal, the first side, and the body portion, and a second conductive material is integrally formed into each of the second edge seal, the second side and the body portion.

6. The rotor disk of claim 1, wherein the body portion includes a plurality of devises.

7. The rotor disk of claim 1, wherein the body portion includes a plurality of hooks.

8. A gas turbine engine, the engine comprising:

a rotor disk;

a plurality of airfoils formed from aluminum or an aluminum alloy extending radially outwardly from the rotor disk, each airfoil of the plurality of airfoils being circumferentially spaced apart from one another;

a sheath covering a leading edge of each airfoil, wherein the sheath is formed from a different material than the airfoil; and a plurality of discrete fan platforms located between adjacent airfoils and configured to ground the sheath of one of the adjacent airfoils to the rotor disk without using the airfoil as a conductor;

wherein each fan platform has a flow path surface extending between a first side and a second side;

an inner surface extending between the first side and the second sides, the inner surface radially opposing the flow path surface; and a body portion extending radially inwardly from the inner surface, the body portion being secured to the rotor disk.

9. The gas turbine engine of claim 8, further including a first edge seal disposed on the first side, wherein the first edge seal provides a conductive path between the body portion and the sheath.

10. The gas turbine engine of claim 9, further including a second edge seal disposed on the second side, wherein the second edge seal provides a conductive path between the body portion and the sheath.

11. The gas turbine engine of claim 10, wherein the first edge seal, the first side, the second side and the body portion are coated with a conductive material.

12. The gas turbine engine of claim 10, wherein a first conductive material is integrally formed into each of the first edge seal, the first side, and the body portion, and a second conductive material is integrally formed into each of the second edge seal, the second side, and the body portion.

13. The gas turbine engine of claim 8, wherein the body portion includes a plurality of devises attached to corresponding lugs disposed on the rotor disk.

14. The gas turbine engine of claim 8, wherein the body portion includes a plurality of platform hooks retained to corresponding retention hooks disposed on the rotor disk.

15. A method of electrically grounding a protective sheath of an airfoil formed from aluminum or an aluminum alloy of a gas turbine engine, the method comprising:

providing a first conductive path from the protective sheath to a rotor disk without using the airfoil as a portion of the first conductive path, wherein the first conductive path travels through a fan platform located adjacent the airfoil, wherein each fan platform has a flow path surface extending between a first side and a second side and an inner surface extending between the first side and the second sides, the inner surface radially opposing the flow path surface; and a body portion extending radially inwardly from the inner surface, the body portion being secured to the rotor disk.

16. The method of claim 15, further including forming a first edge seal on the first side so that the first conductive path from the first side to the body portion via the first edge seal, and forming a second edge seal on the second side so that a second conductive path travels from the second side to the body portion via the second edge seal.

17. The method of claim 16, wherein the first conductive path is formed by coating each of the first side, the first edge seal, and the body portion in a conductive material, and the second conductive path is formed by coating each of the second side, the second edge seal, and the body portion in the conductive material.

18. The method of claim 16, wherein the first conductive path is formed by integrally forming a conductive material into each of the first side, the first edge seal, and the body portion, and the second conductive path is formed by integrally forming a second conductive material into each of the second side, the second edge seal, and the body portion.

* * * * *